US010800435B2

(12) United States Patent
Shi et al.

(10) Patent No.: US 10,800,435 B2
(45) Date of Patent: Oct. 13, 2020

(54) SAFETY FOOTBOARD FOR RAIL TRANSIT PLATFORM

(71) Applicant: SHANGHAI JIACHENG RAILWAY TRANSPORTATION SAFETY SYSTEM CORPORATION, Shanghai (CN)

(72) Inventors: Heping Shi, Shanghai (CN); Xianao Yin, Shanghai (CN); Chaoying Zhang, Shanghai (CN); Jinliang Zhu, Shanghai (CN)

(73) Assignee: SHANGHAI JIACHENG RAILWAY TRANSPORTATION SAFETY SYSTEM CORPORATION, Shanghai (CN)

( * ) Notice: Subject to any disclaimer, the term of this patent is extended or adjusted under 35 U.S.C. 154(b) by 354 days.

(21) Appl. No.: 15/741,463

(22) PCT Filed: Jul. 1, 2016

(86) PCT No.: PCT/CN2016/088110

§ 371 (c)(1),
(2) Date: Jan. 2, 2018

(87) PCT Pub. No.: WO2017/000911

PCT Pub. Date: Jan. 5, 2017

(65) Prior Publication Data

US 2018/0362054 A1 Dec. 20, 2018

(30) Foreign Application Priority Data

Jul. 1, 2015 (CN) ..... 2015 1 0377222

(51) Int. Cl.
*B61B 1/02* (2006.01)
*B61B 12/02* (2006.01)

(52) U.S. Cl.
CPC ..... *B61B 1/02* (2013.01); *B61B 12/024* (2013.01)

(58) Field of Classification Search
CPC ..... B61B 1/02; B61B 12/024
See application file for complete search history.

(56) References Cited

U.S. PATENT DOCUMENTS 5,775,232 A * 7/1998 Golemis ..... B61D 23/025 105/458
5,845,579 A * 12/1998 Langley ..... B61B 12/024 104/31

(Continued)

FOREIGN PATENT DOCUMENTS

CN 101125551 2/2008
CN 101125552 2/2008

(Continued)

OTHER PUBLICATIONS

International Search Report for international appl. No. PCT/CN2016/088110, dated Oct. 9, 2016 (6 pages, included English translation).

(Continued)

*Primary Examiner* — Michael C Zarroli
(74) *Attorney, Agent, or Firm* — Hamre, Shumann, Mueller & Larson, P.C.

(57) ABSTRACT

A safety footboard for a rail transit station comprises a fixed frame base, a sliding frame, and a footboard member, the footboard member being fixed in the front of the sliding frame. The sliding frame is arranged within the fixed frame base, being in sliding connection with the fixed frame base, and horizontally extending from and retracting to the fixed frame base with the guidance of guide rails and guiding means. A driving motor is fixed on the fixed frame base, and racks are fixed on the sliding frame, the racks being driven (Continued)

by the driving motor, pushing or pulling the sliding frame to extend from or retract to the fixed frame base.

9 Claims, 5 Drawing Sheets

(56) References Cited

U.S. PATENT DOCUMENTS

| | | | | |
|---|---|---|---|---|
| 6,167,816 | B1 * | 1/2001 | Lavery | B61D 23/025 105/458 |
| 6,341,563 | B1 * | 1/2002 | Gal | B61D 19/026 104/28 |
| 7,178,467 | B2 * | 2/2007 | Le Bellec | B61D 23/02 105/458 |
| 7,744,337 | B2 * | 6/2010 | Kaufmann | B65G 57/06 414/796.9 |
| 7,784,406 | B2 * | 8/2010 | Chisena | B61K 13/04 104/28 |
| 9,932,045 | B2 * | 4/2018 | Geddie | B61K 13/04 |
| 10,053,114 | B2 * | 8/2018 | Lieber | E06B 11/022 |
| 2010/0043664 | A1 * | 2/2010 | Winkelmann | B60R 3/02 104/31 |
| 2010/0058949 | A1 * | 3/2010 | Lomberty | B65G 69/2882 104/31 |

FOREIGN PATENT DOCUMENTS

| | | | | |
|---|---|---|---|---|
| CN | 100554057 | | 10/2009 | |
| CN | 101746377 | | 6/2010 | |
| CN | 101746377 | A * | 6/2010 | B61B 1/02 |
| CN | 103879409 | | 6/2014 | |
| CN | 104554282 | | 4/2015 | |
| CN | 204341017 | | 5/2015 | |
| CN | 104925068 | | 9/2015 | |
| CN | 204750153 | | 11/2015 | |
| JP | 2008044543 | | 2/2008 | |

OTHER PUBLICATIONS

Office Action issued in corresponding Chinese Application No. 201510377222.X, dated May 3, 2018, with English translation, 6 pages provided.

Office Action issued in corresponding Chinese Application No. 201510377222.X, dated Dec. 10, 2018, with English translation, 14 pages provided.

Qi et al., Mechanical Principle (Second Edition), China Electric Power Press, pp. 121-125, published Jan. 31, 2014; with concise explanation of relevance.

* cited by examiner

SAFETY FOOTBOARD FOR RAIL TRANSIT PLATFORM

TECHNICAL FIELD

This present disclosure relates to the field of rail transit, and particularly relates to a technology of rail transit safety assurance.

BACKGROUND TECHNIQUE

In the process of rail transit construction, in order to ensure the safe driving of the train, usually there is a gap between the platform and the train body. The gap brings about some potential safety hazard to the passengers. Passengers may be easily tripped over the gap during boarding or got stuck in the gap as a result of treadmilling. In order to solve this problem, some existing railway lines are provided with fixed rubber footboards at the edge of the platform to reduce the gap between the platform and the train body. In the meantime, when the train is moving, it is not easy to damage the train body even with the friction between the train body and the footboard.

However, the prior art has the following disadvantages:

First of all, although the gap between the platform and the body of the train is reduced, it still exists and there are still potential safety issues. This is particularly the case for disabled people, infants and young women wearing high heels.

Second, the train is moving, it is easy for the train body and the footboard to rub and impact each other, and the train body will be damaged in the long term. In addition, the damage rate of platform footboards is relatively high, and the post-maintenance cost is high.

SUMMARY

The technical problem mainly solved in some embodiments of the present invention is to provide a safety footboard for a rail transit platform which can effectively avoid potential safety hazards brought by the gap between the platform and the train door to the passengers, and does not form obstruction to a moving train.

To solve the above technical problem, some embodiments of the present invention provide a safety footboard for a rail transit platform, comprising: a fixed frame base, a sliding frame and a footboard member, the footboard member is fixed in the front of the sliding frame; the sliding frame is arranged within the fixed frame base, being in sliding connection with the fixed frame base through guide rails and guiding device, and horizontally extending from and retracting to the fixed frame base with the guidance of the guide rails and guiding device; a driving motor is fixed on the fixed frame base, and racks are fixed on the sliding frame along the extending or retracting direction of the sliding frame, the racks are driven by the driving motor, pushing or pulling the sliding frame to extend from or retract to the fixed frame base.

In an embodiment, the racks are located in the middle of the sliding frame; a gear is fixed on the driving rod of the driving motor and engaged with the racks on the sliding frame, driving the racks. Transmission through the racks, makes the entire transmission system failure rate lower, and the transmission is safer.

In an embodiment, at least two transmission racks are fixed at different positions in the transverse direction of the sliding frame; a transmission rod is fixed on the fixed frame base, and at least one main driving node and at least two driven nodes are set on the transmission rod; the main driving node is transmissionally connected with the driving motor, and each of the driven nodes is transmissionally connected with each driving racks on the sliding frame respectively.

In an embodiment, the left and right sides of the sliding frame and the left and right sides of the fixed frame base are transmissionally connected by a set of gears and racks respectively.

the left and right sides of the sliding frame and the left and right sides of the fixed frame base are respectively and transmissionally connected by a set of bevel gears and racks inclined towards the center.

In an embodiment, the guide rails and guiding device is a guide rails and roller type slider assembly, and at least three sets of guide rails and roller type slider assembly are set at different positions in the transverse direction of the fixed frame base and the sliding frame.

In an embodiment, the sliding frame and the fixed frame base are respectively provided with an extending-in-position limiting assembly and a retracting-in-position limiting assembly, and a position limiting stopper, the position limiting stopper restricts the movement of the sliding frame between the extending-in-position limiting assembly and the retracting-in-position limiting assembly.

In an embodiment, the guiding device is in movably connection with the fixed frame base and can be slightly moved upwardly and downwardly, and each region where the movable connecting portions can move up and down respectively corresponds to a weighing sensor, the output of the weighing sensors are connected to a weighing transmitter which adds up the signals from the weighing sensors, the output of the weighing transmitter is connected to the drive controller of the safety footboard.

In an embodiment, the guiding device is a roller type slider assembly; the movably connection mode between the guiding device and the fixed frame base is that one end of the roller type slider assembly is fixed on the longitudinal beam of the fixed frame base, the other end of the roller type slider assembly is movably connected to the longitudinal beam and can be slightly moved upwardly and downwardly within a limited range; the weighing sensor is set above or below one end of the movable connection between the roller type slider assembly and the longitudinal beam, the roller type slider assembly is slightly moved by gravity to press the weighing sensor.

In an embodiment, the fixed frame base is provided with a load-bearing beam, the load-bearing beam is covered with a footboard, and a sealing strip is included between the footboard and the fixed frame base.

Compared with the prior art, some embodiments of the present invention have the following main differences and effects: a safety footboard is provided with the fixed frame base, the sliding frame and the footboard member, and the footboard member is fixed in the front of the sliding frame; wherein, the sliding frame is arranged within the fixed frame base, being in sliding connection with the fixed frame base through guide rails and guiding device, and horizontally extending from and retracting to the fixed frame base with the guidance of the guide rails and guiding device; a driving motor is fixed on the fixed frame base, and racks are fixed on the sliding frame along the extending or retracting direction of the sliding frame, the racks are driven by the driving motor, pushing or pulling the sliding frame to extend from or retract to the fixed frame base. The safety footboard can effectively avoid potential safety hazards brought by a gap between a platform and a train door, and does not form obstruction to a moving train. Extensions of the safety footboard can be adjusted, meeting requirements of diversified environments of platforms having different gap widths, such as an arc-shaped station and a platform for multiple train models. In addition, by means of a racks driving manner, a fault rate of a drive system can be effectively reduced, ensuring stability and safety during operating of the footboard.

DETAILED DESCRIPTION OF EMBODIMENTS

To make the objectives, technical solutions, and advantages of the present invention clearer, some embodiments of the present invention are further described in detail below with reference to the accompanying drawings.

Figure 1:
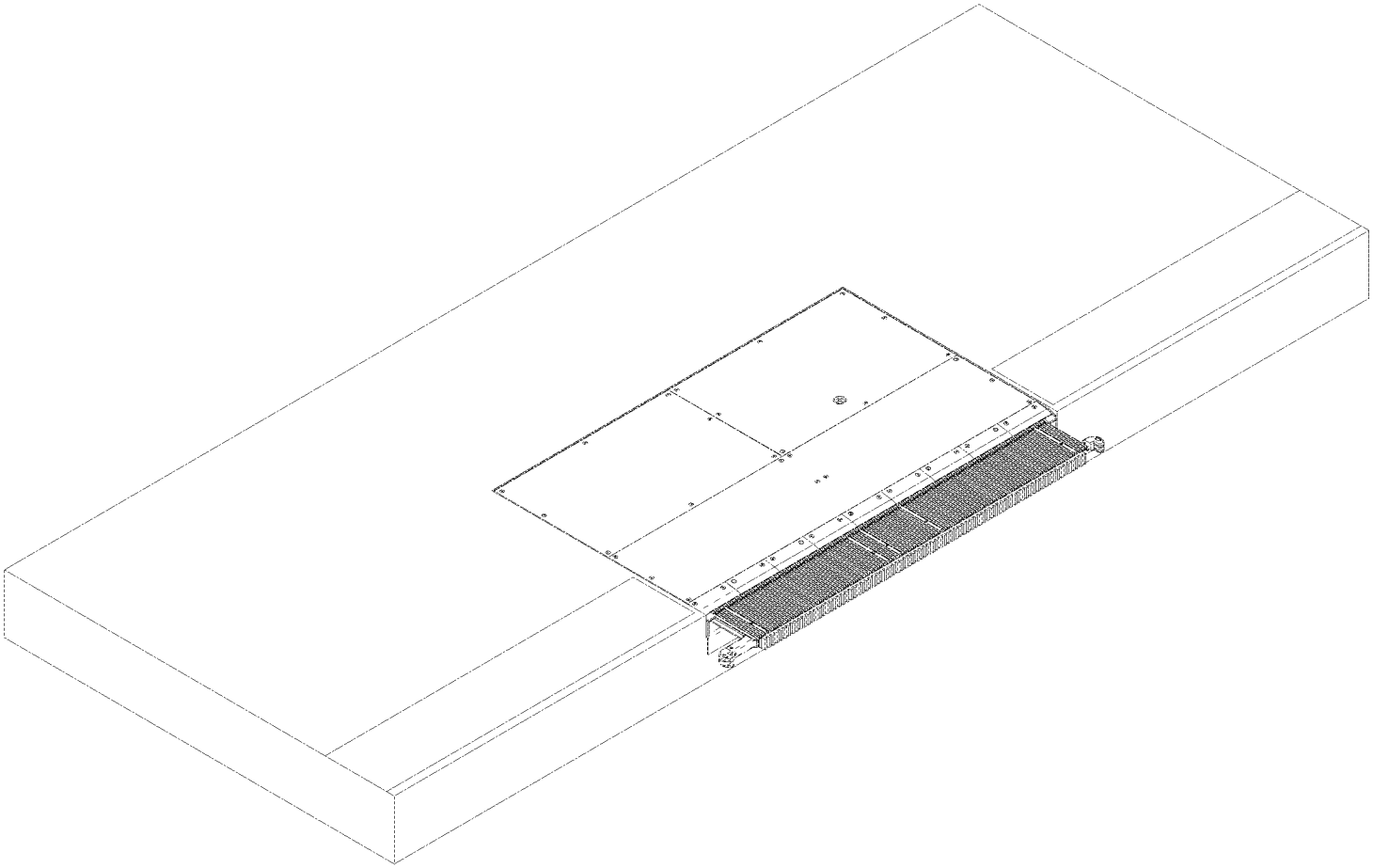
FIG. 1 is a schematic diagram of a safety footboard mounted on a platform according to the first embodiment of the present invention.
Figure 2:
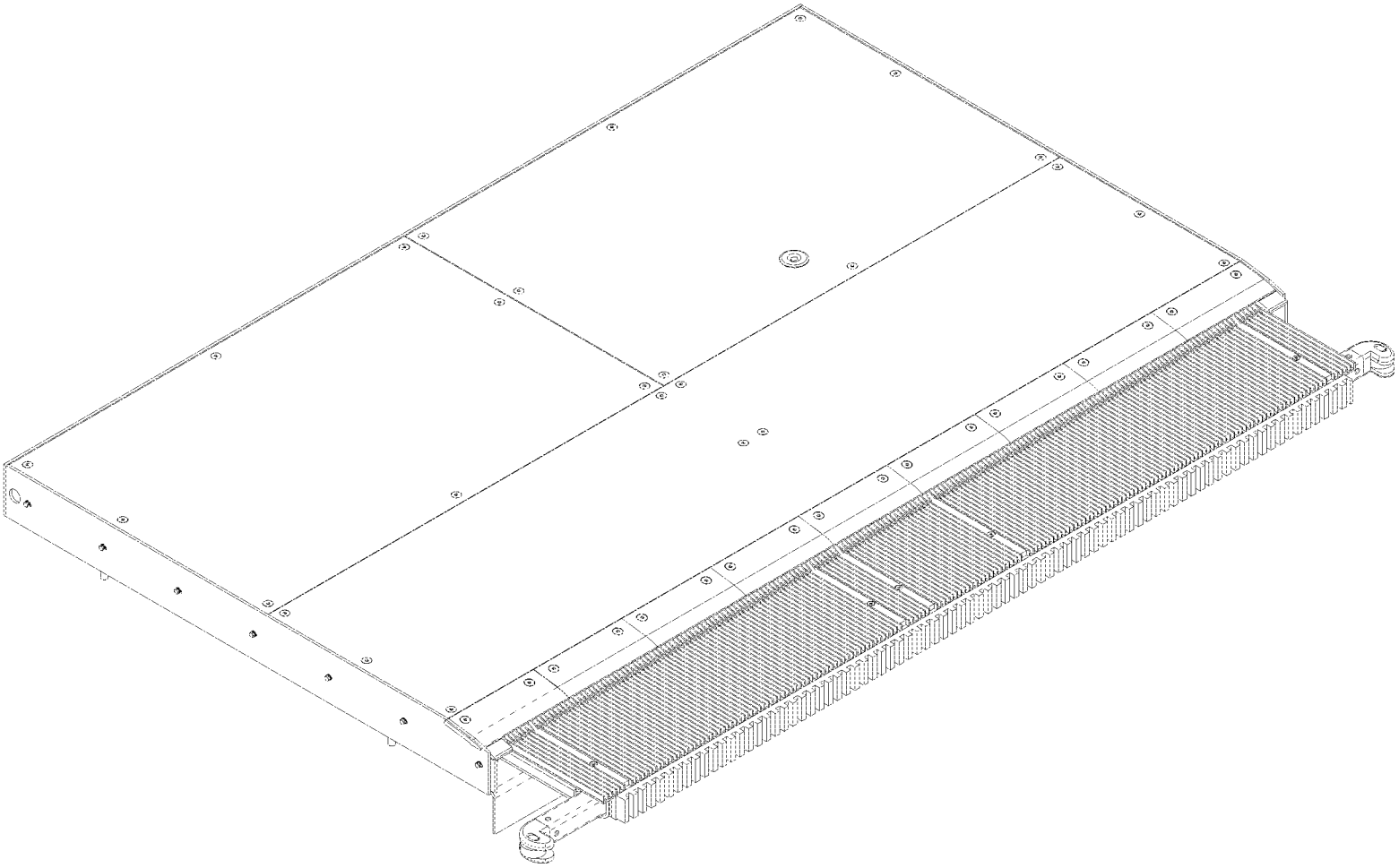
FIG. 2 is a schematic diagram of a safety footboard in the extended state in the first embodiment of the present invention.
Figure 3:
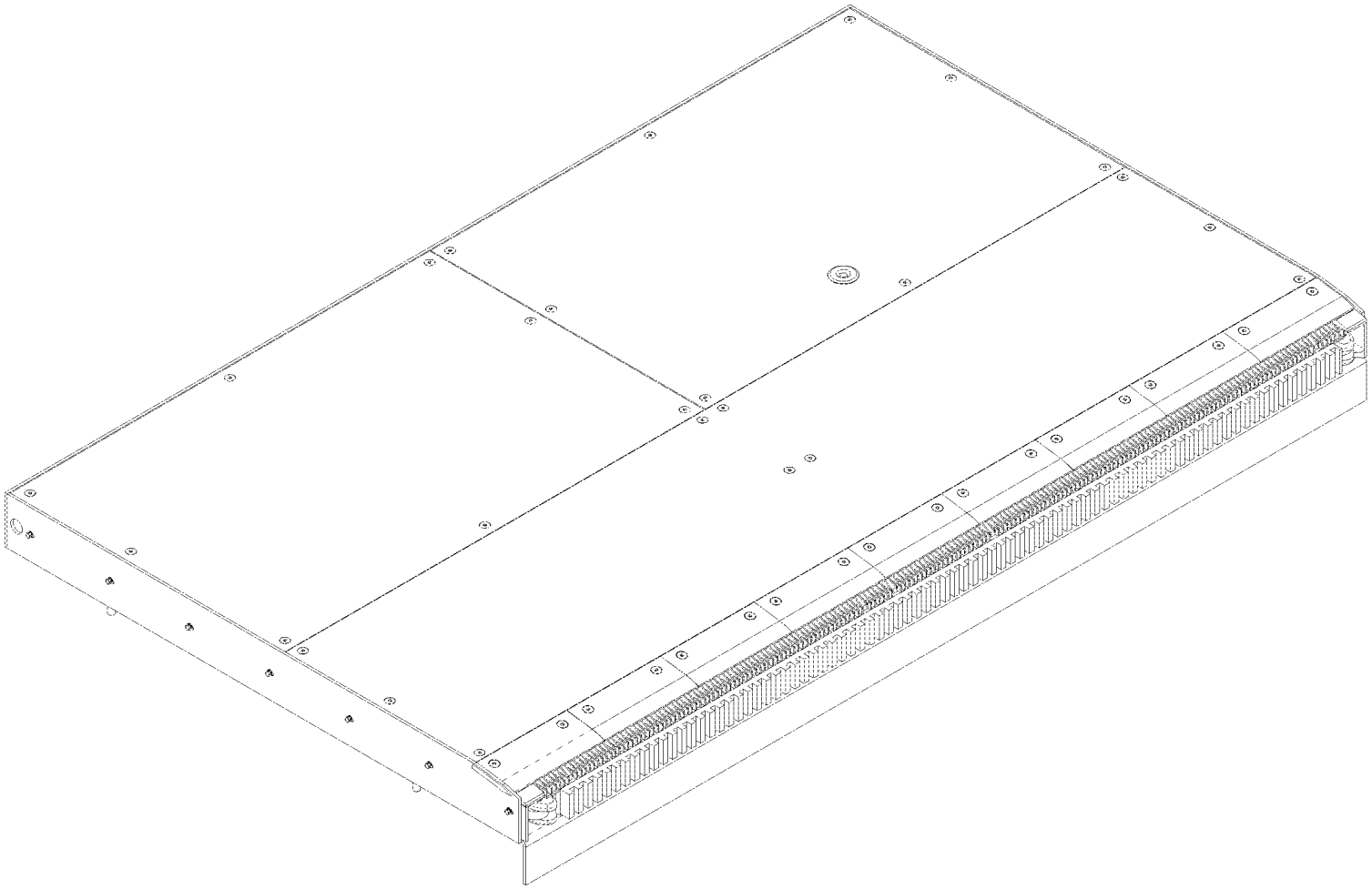
FIG. 3 is a schematic diagram of a safety footboard in a retracted state in the first embodiment of the present invention.

The first embodiment relates to a safety footboard for a rail transit platform. It is used to fill the gap between the rail station and the train doors, to prevent passengers from tripping over the gap when getting on and off the train, or by stomping into the gap. The safety footboard is mounted on the edge of the platform, as shown in FIG. 1. The safety footboard has two states which are extended state and retracted state, as shown in FIG. 2 and FIG. 3 respectively. When the train door is opened in the rail station, the safety footboard is extended to ensure seamless connection between the platform and the train door. Before the train starts, the safety footboards retract back to the platform. During the train running, the safety footboards are retracted to keep a certain gap between the platform and the train body to ensure the safe driving of the train.

Figure 4:
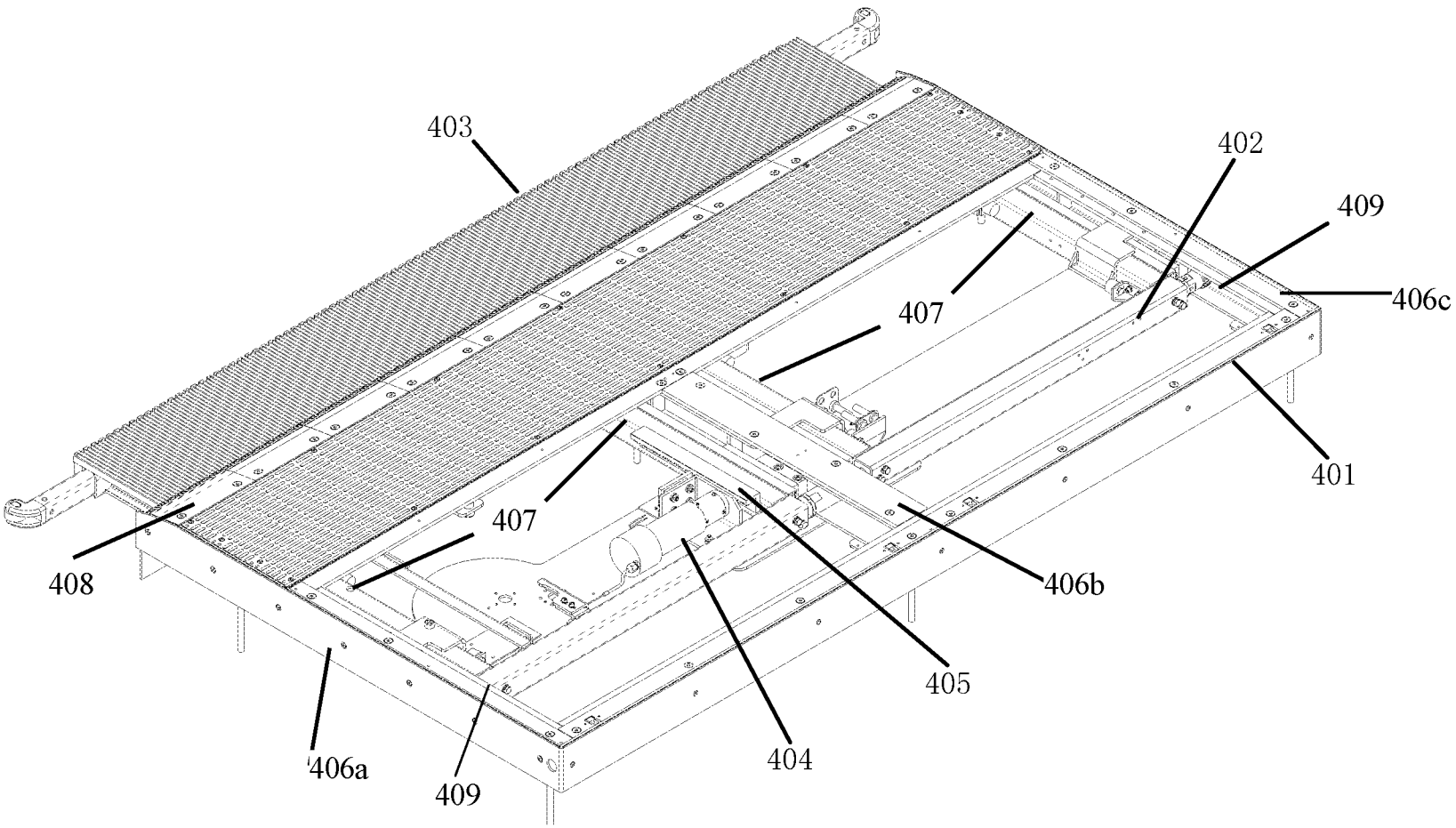
FIG. 4 is a schematic diagram of the structure of the platform safe footboard in the first embodiment of the present invention.

The following describes the specific structure of the safety footboard. As shown in FIG. 4, the safety footboard includes a fixed frame base 401, a sliding frame 402 and a footboard member 403. The footboard member 403 is fixed in the front of the sliding frame 402. The sliding frame 402 is set in the fixed frame base 401 and slidably connected with the fixed frame base 401 via the guide rails and the guiding device. The sliding frame 402 is guided by the guide rails and the guiding device horizontally extending from or retracting to the fixed frame base 401. The extended state and retracted state are shown in FIG. 2 and FIG. 3.

A driving motor 404 is fixed on the fixed frame base 401. A rack 405 is fixed on the sliding frame 402 in extending and retracting direction of the sliding frame. The rack 405 is driven by the driving motor 404 to push the sliding frame 402 to extend from or retract to the fixed frame base 401. In the present embodiment, the sliding frame is an integrated frame structure, so as to ensure the stable structure and prevent the deformation during prolonged use. The footboard member 403 is a tooth-shaped anti-skid footboard to increase the frictional force. In practical applications, the ordinary smooth surface footboard can also be used.

In this embodiment, the guide rails and guiding device is the guide rails and roller type slider assembly. In order to ensure that the sliding frame 402 of the safety footboard does not sink or deform during the extending and retracting. Four sets of guide rails and roller type slider assembly are set on different horizontal positions of the fixed frame base 401 and the sliding frame 402. Specifically, the fixed frame base 403 includes three longitudinal beams 406*a*, 406*b* and 406*c* located at the left and right sides of the fixed frame base 403 and the middle thereof, respectively. Four roller type slider assemblies (two roller type slide blocks in each assembly) are fixed on the three longitudinal beams 406*a*, 406*b* and 406*c* of the fixed frame base 401 to form two symmetrical left and right parts; the sliding frame 402, which is divided into two parts, includes four longitudinal beams 407. Four rails are fixed on the four longitudinal beams 407, corresponding to four roller type slider assemblies on the fixed frame base 401. The sliding frame 402 is in a slidably plug-in connection with the roller type slider assembly on the fixed frame base 401 via a guide rail. The sliding frame 402 is guided by the guide rail and the roller-shaped slider to extend from or retract to the fixed frame base 401 horizontally. The footboard member 403 is fixed in the front of the sliding frame 402, extending from or retracting to the fixed frame base 401 as the sliding frame 402 extending or retracting.

The top of the fixed frame base 401 is covered with a bearing cover for the passengers to stand. In the case that the footboard member 403 is a tooth-shaped anti-skid footboard, a set of comb plates 408 can be fixed in the front of the fixed frame base 401 to engage with the tooth-shaped anti-skid footboard on the sliding frame. During the retraction of the tooth-shaped anti-skid footboard into the fixed frame base 401, rubbish on the tooth-shaped anti-skid footboard is automatically swept by the comb plates. In practice, the comb plate can be fixed on the front of the load-bearing cover.

A driving motor 404 is mounted on the fixed frame base 401, and a gear is fixed on the output shaft of the front end of the driving motor 404. A rack 405 is fixed on the middle portion of the sliding frame 402 along the telescopic direction of the sliding frame to mesh with the gear at the front end of the driving motor 404. When the driving motor 404 rotates, the gears on the output shaft are driven to rotate synchronously, the sliding frame 402 is pushed to extend from or retract to the fixed frame base 401. The tooth surface of the rack 405 is downwardly engaged with the gear at the front end of the driving motor 404 to prevent the rack from accumulating dust and rubbish during prolonged use, which affects the normal operation of the rack.

The retractable safety footboard can effectively avoid potential safety hazards brought by a gap between a platform and a train door, and does not form obstruction to a moving train. Extensions of the safety footboard can be adjusted as needed, meeting requirements of diversified environments of platforms having different gap widths, such as an arc-shaped station and a platform for multiple train models. In addition, by means of a racks driving manner, a fault rate of a drive system can be effectively reduced, ensuring stability and safety during operating of the footboard.

In another embodiment, in order to prevent the sliding frame from being laterally displaced or deformed during extending from and retracting to the fixed frame base, the left and right sides of the sliding frame 402 and the left and right sides of the fixed frame base 401 transmissionally connected by a set of bevel gears and racks inclined towards the center respectively. Specifically, centripetal bevel racks 409 is respectively fixed on the lateral surfaces of the left and right longitudinal beams 406*a* and 406*c* of the fixed frame base 401, and both of the centripetal bevel racks 409 are inclined toward the center. The inclined angle of the bevel of the heart bevel gear is relatively symmetrical (i.e., like the shape of Chinese character "A" or it's upside down); a centripetal bevel gear is respectively fixed on the left and right sides of the sliding frame 402, and the tooth profiles of the two centripetal bevel gears are also inclined toward the center, and the relative tilt angles are symmetry and match with the centripetal bevel racks at corresponding position. Through the two sets of set of bevel gears and racks inclined towards the center, a set of lateral tensile forces of opposite directions and the same size can be received while the sliding frame 402 is extending from or retracting to the fixed frame base 401, so as to effectively prevent the sliding frame lateral displacement occurs during extending from and retracting to the base of the fixing frame, thereby preventing deformation thereof. It should be noted that the ordinary spur gears and racks instead of the above mentioned bevel gears and racks can also have a certain degree of lateral displacement prevention effect.

The fixed frame base 401 is provided with a extending-in-position limiting assembly and a retracting-in-position limiting assembly. A position limiting stopper is set on the sliding frame 402, and the position limiting stopper is located between the extending-in-position limiting assembly and the retracting-in-position limiting assembly to limit the sliding frame 402 to move between the extending-in-position limiting assembly and the retracting-in-position limiting assembly. Thereby the retractable position of the footboard is physically restricted to ensure that the footboard is retracted within a predetermined range. By adjusting the forward and backward position of the extending-in-position limiting assembly and the setting to drive the rotation of the driving motor, the extending length of the footboard member can be changed, so as to meet the requirement of a wide range of trains and platform gap widths, such as arc platform and multi-models train platform.

A set of proximity switches are respectively fixed on the fixed frame base 401 and the sliding frame 402, and are respectively set at the position of extending-in-position limiting assembly on the fixed frame base 401 and the position of position limiting stopper on the sliding frame 402. The signal output of each of the proximity switches are connected to the controller. When the sliding frame 402 is extended to the position, the position limiting stopper and the extending-in-position limiting assembly are close to each other, and the proximity switch provided at the position of the position limiting stopper detects that the extending-in-position limiting assembly on the sliding frame 402 enters the measuring range, the proximity switch at the position of the position limiting stopper detects that the extending-in-position limiting assembly on the fixed frame base 401 enters the range of the measuring range, and respectively sends an electrical signal to the controller. Based on the received electrical signal, the controller determines that the footboard has extended in place.

In another embodiment, the driving motor 404 may include a brake. The driving motor 404 is connected to the controller. The brake controls the driving motor in the non-operating state, and unlocked the driving motor 404 once received the command of starting the motor from the controller. Therefore, the motor can be locked to ensure the footboard can not move back and forth when the footboard is retracted and the motor is stopped. Alternatively, in the event of a sudden power failure, the motor can be locked in time by a brake to control the footboard to stop scaling, and ensure that the footboard is at a standstill during a power outage without scaling back and forth to ensure passenger safety.

In another embodiment, the safety footboard in the present embodiment further includes a weighing structure, which is specifically as follows: the guiding device is in movably connection with the fixed frame base and can be slightly moved upwardly and downwardly, and each region where the movable connecting portions can move up and down respectively corresponds to a weighing sensor, the output of the weighing sensors are connected to a weighing transmitter which adds up the signals from the weighing sensors, the output of the weighing transmitter is connected to the drive controller of the safety footboard.

Specifically, the guiding device in this embodiment is a roller type slider assembly fixed on the side of the longitudinal beams 406*a*, 406*b*, 406 of the fixed frame base, wherein, a row (four) roller type slider assembly relatively far from the footboard member 402 is in movably connection with the fixed frame base 401 and can be slightly moved upwards and downwards. The detail of the movable connection mode is as follows: one end of the roller type slider assembly is fixed on the longitudinal beam of the fixed frame base, the other end is movably connected with the slotted hole of the longitudinal beam, and can be slightly moved upwardly and downwardly within a limited range of the slotted hole. When there is a heavy object on the footboard member 402 or someone stands, the sliding frame at the end where the footboard member is located and the guide rail on the sliding frame are pressed down, the other end of the guide rail (away from the footboard member) is also pressed down synchronously to press the roller type slider assembly downward. Due to the lever principle, roller type slider assembly suffered much less force. 4 high-precision weighing sensors are installed at the position where 4 roller type slider assemblies can be slightly moved up and down, the output of the 4 sensors are connected to a weighing transmitter which has 4 input and 1 output. When the 4 roller type slider assemblies are subjected to downward pressure, the 4 weighing sensors are respectively weighted according to the force received and send the output signal to the weighing transmitter, and the weighing transmitter superimposes the signal from each weighing sensor, and the superimposed current signal is transmitted to the MGF controller, then the weight value can be get with the A/D converter.

The weighing structure can prevent the weighing sensors from being impacted by the load on the footboard. With the lever principle, the vertical downward force on the footboard member is converted to the other end of the lever (ie, the guide rail) by a certain proportion, so that large direct impact force was converted into smaller indirect impact force. Therefor the weighing structure can offer good protection to the weighing sensors, and solved the problem that large-scale weighing sensor accuracy is not enough (can not be induced to less than 10 kg of gravity), the accuracy of the weighing sensors is relatively small range, and the direct footboarding force is too large and easy to damage the weighing sensors. Thus, the weighing range of the weighing structure can be enlarged while the weighing accuracy of the weighing structure can be increased, so as to ensure the service life of the weighing structure.

Figure 5:
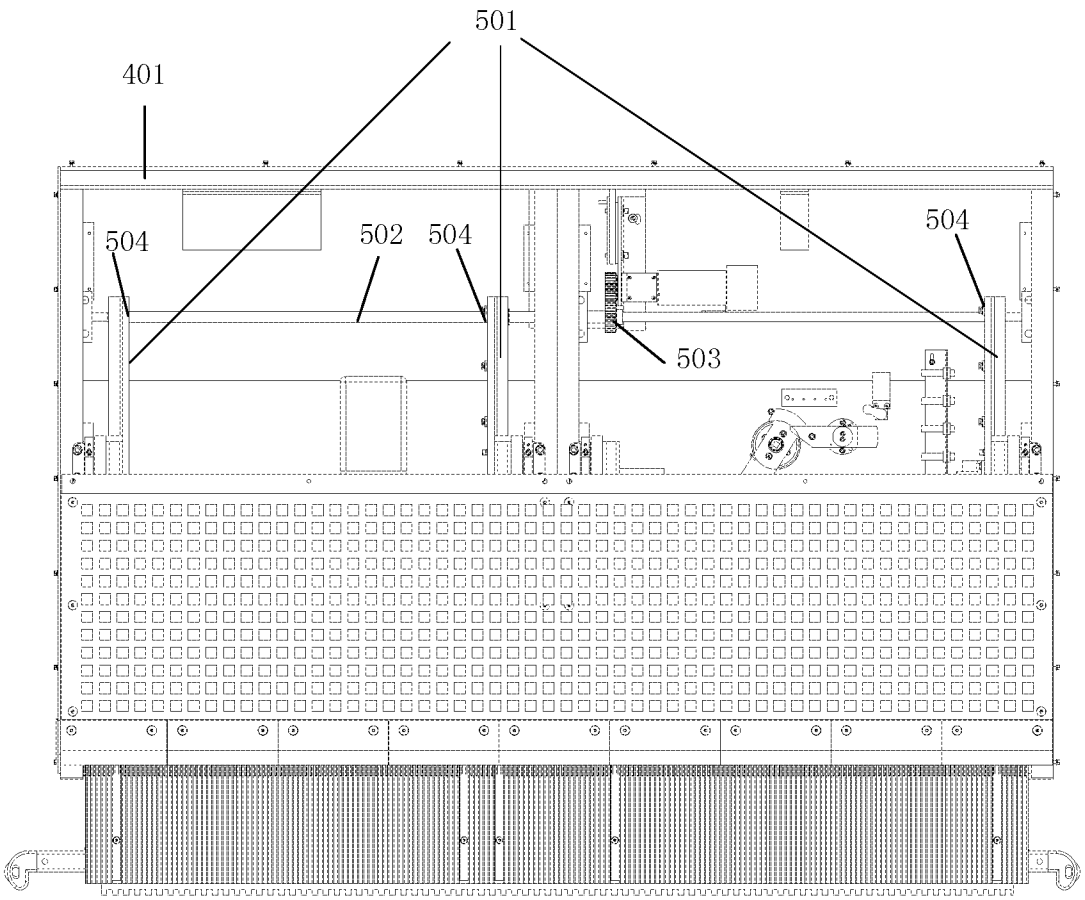
FIG. 5 is a schematic diagram of the structure of the platform safe footboard in the second embodiment of the present invention.

The second embodiment also relates to a safety footboard for a rail transit platform, which is substantially the same as the first embodiment, except that in the first embodiment, the driving motor drives only one rack, and the sliding frame is driven by the rack to extend from or retract to the fixed frame base. In the present embodiment, as shown in FIG. 5, three transmission racks 501 are fixed at different positions in the horizontal direction of the sliding frame 402, a transmission rod 502 is fixed on the fixed frame base 401, a main driving node 503 and three sub-driving nodes 504 are provided on the transmission rod 502. The main driving node 503 is drivably connected to the driving motor 404 through a set of gears (a driving gear is fixed on the main driving node 503, and another driving gear is fixed on the output shaft of the front end of the driving motor 404, the two gears are engaged to transmission). A transmission gear is fixed on each driven node 504, and engaged with the transmission racks 501 on the sliding frame to form transmission connection.

With the above structure, when the driving motor 404 rotates, the gears on the main driving node 503 rotate synchronously to drive the transmission rod 502 to rotate synchronously, which in turn drives the three driven nodes 504 to rotate synchronously. Finally, the gears on the three driven nodes 504 are driven to drive the three transmission racks 501 on the sliding frame, so that the sliding frame are driven to extend from or retract to the fixed frame base.

By simultaneously controlling the safety footboard extending and retracting at coaxial three points (or more), it is ensured that the sliding frame of the safety footboard can be multipointly stressed during the extending and retracting, so as to ensure that the sliding frame is uniformly stressed in different positions in the transverse direction. Therefor, the sliding frame is not prone to deformation in long term operation. It's life is extended, and the stability and security of its operation is ensured.

Some example are provided as following:

Example 1

A safety footboard for a rail transit platform, wherein the safety footboard comprises a fixed frame base, a sliding frame and a footboard member, the footboard member is fixed in the front of the sliding frame; the sliding frame is arranged within the fixed frame base, being in sliding connection with the fixed frame base through guide rails and guiding device, and horizontally extending from and retracting to the fixed frame base with the guidance of the guide rails and guiding device; a driving motor is fixed on the fixed frame base, and racks are fixed on the sliding frame along the extending or retracting direction of the sliding frame, the racks are driven by the driving motor, pushing or pulling the sliding frame to extend from or retract to the fixed frame base.

Example 2

The safety footboard for a rail transit platform according to example 1, wherein the racks are located in the middle of the sliding frame; a gear is fixed on the driving rod of the driving motor and engaged with the racks on the sliding frame, driving the racks.

Example 3

The safety footboard for a rail transit platform according to example 1 or 2, wherein at least two transmission racks are fixed at different positions in the transverse direction of the sliding frame; a transmission rod is fixed on the fixed frame base, and at least one main driving node and at least two driven nodes are set on the transmission rod; the main driving node is transmissionally connected with the driving motor, and each of the driven nodes is transmissionally connected with each driving racks on the sliding frame respectively.

Example 4

The safety footboard for a rail transit platform according to example 1 or 2, wherein the left and right sides of the sliding frame and the left and right sides of the fixed frame base are transmissionally connected by a set of gears and racks respectively.

Example 5

The safety footboard for a rail transit platform according to example 4, wherein the left and right sides of the sliding frame and the left and right sides of the fixed frame base are respectively and transmissionally connected by a set of bevel gears and racks inclined towards the center.

Example 6

The safety footboard for a rail transit platform according to example 1-5, wherein the guide rails and guiding device is a guide rails and roller type slider assembly, and at least three sets of guide rails and roller type slider assembly are set at different positions in the transverse direction of the fixed frame base and the sliding frame.

Example 7

The safety footboard for a rail transit platform according to example 1-6, wherein the sliding frame and the fixed frame base are respectively provided with an extending-in-position limiting assembly and a retracting-in-position limiting assembly, and a position limiting stopper, the position limiting stopper restricts the movement of the sliding frame between the extending-in-position limiting assembly and the retracting-in-position limiting assembly.

Example 8

The safety footboard for a rail transit platform according to example 1-7, wherein the guiding device is in movably connection with the fixed frame base and can be slightly moved upwardly and downwardly, and each region where the movable connecting portions can move up and down respectively corresponds to a weighing sensor, the output of the weighing sensors are connected to a weighing transmitter which adds up the signals from the weighing sensors, the output of the weighing transmitter is connected to the drive controller of the safety footboard.

Example 9

The safety footboard for a rail transit platform according to example 8, wherein the guiding device is a roller type slider assembly; the movably connection mode between the guiding device and the fixed frame base is that one end of the roller type slider assembly is fixed on the longitudinal beam of the fixed frame base, the other end of the roller type slider assembly is movably connected to the longitudinal beam and can be slightly moved upwardly and downwardly within a limited range; the weighing sensor is set above or below one end of the movable connection between the roller type slider assembly and the longitudinal beam, the roller type slider assembly is slightly moved by gravity to press the weighing sensor.

Example 10

The safety footboard for a rail transit platform according to example 1-9, wherein the fixed frame base is provided with a load-bearing beam, the load-bearing beam is covered with a footboard, and a sealing strip is included between the footboard and the fixed frame base.

While some embodiments of the invention have been illustrated and described with reference to certain preferred embodiments thereof, it will be understood by those of ordinary skill in the art that various changes in form and details may be made therein, without departing from the spirit and scope of the invention.

What is claimed:

1. A safety footboard for a rail transit platform, comprising:

a fixed frame base, a sliding frame and a footboard member, the footboard member is fixed in the front of the sliding frame;

the sliding frame is arranged within the fixed frame base, being in sliding connection with the fixed frame base through guide rails and guiding device, and horizontally extending from and retracting to the fixed frame base with the guidance of the guide rails and guiding device;

a driving motor is fixed on the fixed frame base, and racks are fixed on the sliding frame along the extending or retracting direction of the sliding frame, the racks are driven by the driving motor, pushing or pulling the sliding frame to extend from or retract to the fixed frame base, wherein at least two transmission racks are fixed at different positions in the transverse direction of the sliding frame; a transmission rod is fixed on the fixed frame base, and at least one main driving node and at least two driven nodes are set on the transmission rod; the main driving node is transmissionally connected with the driving motor, and each of the driven nodes is transmissionally connected with each driving racks on the sliding frame respectively.

2. The safety footboard for a rail transit platform according to claim 1, wherein the racks are located in the middle of the sliding frame; a gear is fixed on a driving rod of the driving motor and engaged with the racks on the sliding frame, driving the racks.

3. The safety footboard for a rail transit platform according to claim 1, wherein the left and right sides of the sliding frame and the left and right sides of the fixed frame base are transmissionally connected by a set of gears and racks respectively.

4. The safety footboard for a rail transit platform according to claim 3, wherein the left and right sides of the sliding frame and the left and right sides of the fixed frame base are respectively and transmissionally connected by a set of bevel gears and racks inclined towards the center.

5. The safety footboard for a rail transit platform according to claim 1, wherein the guide rails and guiding device is a guide rails and roller type slider assembly, and at least three sets of guide rails and roller type slider assembly are set at different positions in the transverse direction of the fixed frame base and the sliding frame.

6. The safety footboard for a rail transit platform according to claim 1, wherein the sliding frame and the fixed frame base are respectively provided with an extending-in-position limiting assembly and a retracting-in-position limiting assembly, and a position limiting stopper, the position limiting stopper restricts the movement of the sliding frame between the extending-in-position limiting assembly and the retracting-in-position limiting assembly.

7. The safety footboard for a rail transit platform according to claim 1, wherein the guiding device is in movably connection with the fixed frame base and can be slightly moved upwardly and downwardly, and each region where the movable connecting portions can move up and down respectively corresponds to a weighing sensor, the output of the weighing sensors are connected to a weighing transmitter which adds up the signals from the weighing sensors, the output of the weighing transmitter is connected to a drive controller of the safety footboard.

8. A safety footboard for a rail transit platform, comprising:

a fixed frame base, a sliding frame and a footboard member, the footboard member is fixed in the front of the sliding frame;

the sliding frame is arranged within the fixed frame base, being in sliding connection with the fixed frame base through guide rails and guiding device, and horizontally extending from and retracting to the fixed frame base with the guidance of the guide rails and guiding device:

a driving motor is fixed on the fixed frame base, and racks are fixed on the sliding frame along the extending or retracting direction of the sliding frame, the racks are driven by the driving motor, pushing or pulling the sliding frame to extend from or retract to the fixed frame base, wherein at least two transmission racks are fixed at different positions in the transverse direction of the sliding frame; a transmission rod is fixed on the fixed frame base, and at least one main driving node and at least two driven nodes are set on the transmission rod; the main driving node is transmissionally connected with the driving motor, and each of the driven nodes is transmissionally connected with each driving racks on the sliding frame respectively, wherein the guiding device is in movably connection with the fixed frame base and can be slightly moved upwardly and downwardly, and each region where the movable connecting portions can move up and down respectively corresponds to a weighing sensor, the output of the weighing sensors are connected to a weighing transmitter which adds up the signals from the weighing sensors, the output of the weighing transmitter is connected to a drive controller of the safety footboard, and wherein the guiding device is a roller type slider assembly; the movably connection mode between the guiding device and the fixed frame base is that one end of the roller type slider assembly is fixed on a longitudinal beam of the fixed frame base, the other end of the roller type slider assembly is movably connected to the longitudinal beam and can be slightly moved upwardly and downwardly within a limited range; the weighing sensor is set above or below one end of the movable connection between the roller type slider assembly and the longitudinal beam, the roller type slider assembly is slightly moved by gravity to press the weighing sensor.

9. The safety footboard for a rail transit platform according to claim 1, wherein the fixed frame base is provided with a load-bearing beam, the load-bearing beam is covered with the footboard, and a sealing strip is included between the footboard and the fixed frame base.

* * * * *